US006007975A

United States Patent [19]

Tomotake et al.

[11] Patent Number: 6,007,975

[45] Date of Patent: Dec. 28, 1999

[54] SILVER HALIDE COLOR PHOTOGRAPHIC LIGHT-SENSITIVE MATERIAL

[75] Inventors: Atsushi Tomotake; Yoshiko Iwai, both of Hino, Japan

[73] Assignee: Konica Corporation, Japan

[21] Appl. No.: 09/004,195

[22] Filed: Jan. 8, 1998

[30] Foreign Application Priority Data

Jan. 14, 1997 [JP] Japan ..... 9-004603

[51] Int. Cl.[6] ..... G03C 1/08; G03C 7/26; G03C 7/32

[52] U.S. Cl. ..... 430/549; 430/558; 430/552; 430/553

[58] Field of Search ..... 430/558, 552, 430/553, 549

[56] References Cited

U.S. PATENT DOCUMENTS 5,658,720 8/1997 Ikesu et al. ..... 430/558
5,679,506 10/1997 Ikesu et al. ..... 430/558

FOREIGN PATENT DOCUMENTS 1-224761 9/1989 Japan .

*Primary Examiner*—Geraldine Letscher
*Attorney, Agent, or Firm*—Jordan B. Bierman; Bierman, Muserlian and Lucas

[57] ABSTRACT

A silver halide color photographic light-sensitive material is disclosed. The red sensitive silver halide emulsion layer contains at least one cyan coupler represented by the formula (1) or (2) and at least one cyan coupler represented by formula C-1, Formula (1)

Formula (2)

Formula (C-1)

the symbols are defined in the specification.

8 Claims, No Drawings

SILVER HALIDE COLOR PHOTOGRAPHIC LIGHT-SENSITIVE MATERIAL

FIELD OF THE INVENTION

This invention relates to a silver halide color photographic light-sensitive material and, particularly to a silver halide color photographic light-sensitive material excellent in color developability and color reproducibility with low cost.

BACKGROUND OF THE INVENTION

In a silver halide color photographic light-sensitive material which we view directly, for example a color print paper, usually a combination of a yellow, a magenta coupler and a cyan coupler is used. For these couplers it is required basic characteristics such as color reproduction of the dye image, color developability and durability. Recently in particular further improvement for color reproduction is requested for the reproduction of the original color with fidelity.

As for the cyan color image forming couplers, phenols or naphthols have mostly been used so far.

However, the cyan images obtained from the phenols and naphthols having been used so far have had serious problems on color reproduction. The problems have included that an absorption has not beer well-defined on the short-wavelength side and that an unnecessary absorption, i.e., an asymmetric absorption, has also been produced in the green spectral region. Due to the problems, the asymmetric absorption has to be corrected by means of a masking in the case of a color negative film and there has not been any asymmetric absorption correcting means in the case of a color negative paper. Therefore, the color reproduction was considerably deteriorated.

For the purpose of improving the color reproduction, JP OPI Publication Nos. 63-250649, 63-250650, 64-554/1989 and so forth have proposed the cyan couplers of the pyrazoloazole type. However, these couplers have introduced an electron-withdrawing group and a hydrogen-bonding group thereinto for satisfying the absorption wavelength of the color dyes to be formed. Therefore, not only the couplers have not been on the level fully satisfying the coupling activity, though a good color reproducibility has been displayed, but also they have not satisfied both color developability and color reproducibility at the same time. These couplers are required to prepare with low cost.

For the purpose of improving the durability of image and preservability of the dispersion of the couplers, JP OPI Publication No. 1-224761 discloses a combination of a specific cyan coupler of the pyrazoloazole type and a phenol coupler. However the combination of the couplers are requested for an improvement of color developability.

SUMMARY OF THE INVENTION

It is an object of the invention to provide a silver halide color photographic light-sensitive material having an excellent color formation, a sufficient color density and color reproduction with low cost.

The invention and its embodiment is described.

The silver halide color photographic light-sensitive material comprises a blue sensitive silver halide emulsion layer, a green sensitive silver halide emulsion layer and a red sensitive silver halide emulsion layer on a support, in which the red sensitive silver halide emulsion layer contains at least one cyan coupler represented by the formula (1) or (2) and at least one cyan coupler represented by formula C-1, Formula (1)

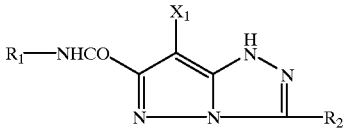

Formula (2)

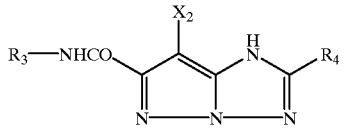

wherein $R_1$ and $R_3$ represent each a branched alkyl group, a substituted alkyl group, a substituted aryl group or a heterocyclic group; $R_2$ and $R_4$ represent each a substituent; and $X_1$ and $X_2$ represent each a hydrogen atom or a coupling-off group, which is capable of being released upon reaction with an oxidation product of a color developing agent, Formula (C-1)

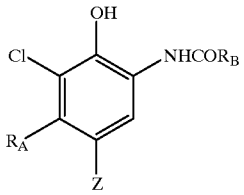

wherein $R_A$ is an alkyl group having carbon number of 2 to 6, $R_B$ is a ballast group, Z is a hydrogen atom or an atom or a radical which is capable of being released upon reaction with an oxidation product of a color developing agent.

Among cyan couplers represented by the formula (1) or (2), the cyan couplers represented by the formula (1) is preferably used.

A group represented by R1 is preferably a branched alkyl or a substituted alkyl group.

In the formula (C-1), $R_A$ is preferably an ethyl group. Z is preferably a chlorine atom.

DETAILED DESCRIPTION OF THE INVENTION

In the above-given formulas (1) and (2), the branched alkyl group represented by $R_1$ and $R_3$ includes, for example, i-propyl group, t-butyl group, sec-butyl group, i-butyl group, t-octyl group and so on.

In case that $R_1$ and $R_3$ represent a substituted alkyl group, the alkyl part of the substituted alkyl group that is substituted may be straight or branched and includes, for example, methyl, ethyl, butyl, i-propyl, t-butyl, sec-butyl, i-butyl, t-octyl, cyclohexyl and so on.

In case that $R_1$ and $R_3$ represent a substituted aryl group, the aryl part of the substituted aryl group that is substituted includes phenyl group.

The heterocyclic groups represented by $R_1$ and $R_3$ include, for example, 2-furyl group, 2-thienyl group, 2-imidazolyl group, 2-thiazolyl group, 3-isoxazolyl group, 3-pyridyl group, 2-pyridyl group, 2-pyrimidyl group, 3-pyrazolyl group and 2-benzothiazolyl group.

In case that $R_1$ and $R_3$ represent each a branched alkyl group or a heterocyclic group these groups may have a substituent.

There is no special limitation to the substituent, which includes, exemplary, each group of alkyl, aryl, anilino, acylamino, sulfonamido, alkylthio, arylthio, alkenyl, cycloalkyl and so forth. Besides the above, the substituents also include, for example, a halogen atom, each group of cycloalkenyl, alkinyl, heterocyclic, sulfonyl, sulfinyl, phosphonyl, acyl, carbamoyl, sulfamoyl, cyano, alkoxy, aryloxy, heterocyclic-oxy, siloxy, acyloxy, sulfonyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclic-thio, thioureido, carboxy, hydroxyl, mercapto, nitro, sulfo and so forth, or also include spiro compound residual group, bridged hydrocarbon residue. These groups may have a substituent mentioned above.

There is no special limitation to the substituents represented by $R_2$ and $R_4$. They include, exemplary, each group of alkyl, aryl, anilino, acylamino, sulfonamido, alkylthio, arylthio, alkenyl, cycloalkyl and so forth. Besides the above, the substituents also include, for example, a halogen atom, each group of cycloalkenyl, alkinyl, heterocyclic, sulfonyl, sulfinyl, phosphonyl, acyl, carbamoyl, sulfamoyl, cyano, alkoxy, aryloxy, heterocyclic-oxy, siloxy, acyloxy, sulfonyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclic-thio, thioureido, carboxy, hydroxyl, mercapto, nitro, sulfa and so forth, or also include spiro compound residual group, bridged hydrocarbon residue.

The alkyl group for the substituents to the branched alkyl group, substituted alkyl, substituted aryl and heterocyclic group represented by $R_1$ and $R_3$, and the substituents represented by $R_2$ and $R_4$ is preferably that having 1 to 32 carbon atoms, and may be straight or branched. As for the aryl group, a phenyl group is preferred.

The acylamino groups include, for example, alkylcarbonylamino group, arylcarbonylamino group and so forth.

The sulfonamido groups include, for example, alkylsulfonylamino group, arylsulfonylamino group and so forth.

The alkyl and aryl components in the alkylthio and arylthio groups include, for example, the alkyl and aryl groups represented by $R_2$ and $R_4$, respectively.

The alkenyl groups include preferably those having 2 to 32 carbon atoms. The cycloalkyl groups include preferably those having 3 to 12 carbon atoms and particularly those having 5 to 7 carbon atoms. The alkenyl groups may be straight-chained or branched.

The cycloalkenyl groups include preferably those having 3 to 12 carbon atoms and particularly those 5 to 7 carbon atoms.

The sulfonyl groups include, for example, alkylsulfonyl group, arylsulfonyl group and so forth; the sulfinyl groups include, for example, alkylsulfinyl group, arylsulfinyl group and so forth;

- the phosphonyl groups include, for example, alkylphosphonyl group, alkoxyphosphonyl group, aryloxyphosphonyl group, arylphosphonyl group and so forth;
- the acyl groups include, for example, alkylcarbonyl group, arylcarbonyl group and so forth;
- the carbamoyl groups include, for example, alkylcarbamoyl group, arylcarbamoyl group and so forth;
- the sulfamoyl groups include, for example, alkylsulfamoyl group, arylsulfamoyl group and so forth;
- the acyloxy groups include, for example, alkylcarbonyloxy group, arylcarbonyloxy group and so forth;
- the sulfonyloxy groups include, for example, alkylsulfonyloxy group, arylsulfonyloxy group and so forth;
- the carbamoyloxy groups include, for example, alkylcarbamoyloxy group, arylcarbamoyloxy group and so forth;
- the ureido groups include, for example, alkylureido group, arylureido group and so forth;
- the sulfamoylamino groups include, for example, alkylsulfamoylamino group, arylsulfamoylamino group and so forth;
- the heterocyclic groups include, preferably, those having 5 to 7 member rings and, exemplary, 2-furyl group, 2-thienyl group, 2-pirimidinyl group, 2-benzothiazolyl group, 1-pyrrolyl group, 1-tetrazolyl group and so forth;
- the heterocyclic-oxy groups include, preferably, those having 5 to 7 member rings and, exemplary, 3,4,5,6-tetrahydropyranyl-2-oxy group, 1-phenyltetrazole-5-oxy group and so forth;
- the heterocyclic-thio groups include, preferably, those having 5 to 7 member rings and, exemplary, 2-pyridylthio group, 2-benzothiazolylthio group, 2,4-diphenoxy-1,3,5-triazole-6-thio group and so forth;
- the siloxy groups include, for example, trimethylsiloxy group, triethylsiloxy group, dimethylbutylsiloxy group and so forth;
- the imido groups include, for example, succinimido group, 3-heptadecyl succinimido group, phthalimido group, glutarimido group and so forth;
- the spiro compound residual groups include, for example, spiro[3,3]heptane-1-il group and so forth; and
- the bridged hydrocarbon residue include, for example, bicyclo[2,2,1]heptane-1-il, tricyclo[3,3,1,1$^{3,7}$]decane-1-i;, 7,7-dimethyl-bicyclo[2,2,1]heptane-1-il and so forth.

Among the above-given substituents represented by $R_2$ and $R_4$, alkyl groups, aryl groups and heterocyclic groups are preferred and, inter alia, aryl groups are particularly preferred.

The above-given groups are also allowed to have such a further substituent as a ballast group including, for example, a long-chained hydrocarbon group, a polymer residual group and so forth.

$X_1$ and $X_2$ represent each a hydrogen atom or a coupling-off group capable of being released upon reaction with the oxidation product of a color developing agent. The coupling-off groups capable of being released upon reaction with an oxidation product of the color developing agent include, for example, a halogen atom (such as a chlorine atom, a bromine atom, a fluorine atom and so forth) and each of the groups of alkoxy, aryloxy, heterocyclic-oxy, acyloxy, sulfonyloxy, alkoxycarbonyloxy, aryloxycarbonyl, alkyloxalyloxy, alkoxyoxalyloxy, alkylthio, arylthio, heterocyclic-thio, alkyloxythiocarbonylthio, acylamino, sulfonamido, nitrogen-containing heterocyclic ring coupled with an N atom, alkyloxycarbonylamino, aryloxycarbonylamino, carboxyl and so forth.

Among them, a hydrogen atom, a halogen atom, an alkoxy group, an aryloxy group, a heterocyclic-oxy group, an alkylthio group, an arylthio group, a heterocyclic-thio group, a nitrogen-containing heterocyclic group coupled with an N atom and so forth.

Among the cyan couplers for silver halide color photographic light-sensitive material represented by Formula (1) or (2) of the invention, those represented by Formula (1) are preferable from the viewpoint of color reproducibility.

A group represented by $R_1$ of the formula (1) is preferably a branched alkyl group or a substituted alkyl group.
The typical examples of the compounds of the cyan couplers for silver halide color photographic light-sensitive material represented by Formula (1) or (2) of the invention will be given below.
(1)
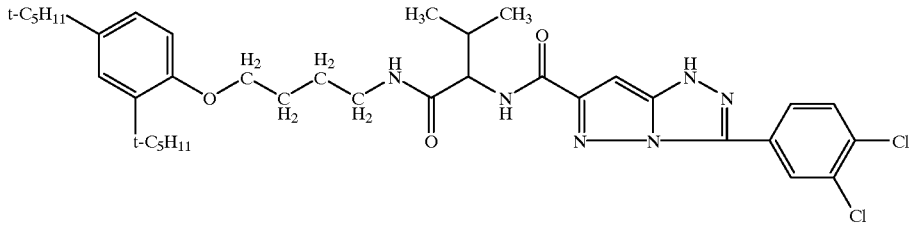
(2)
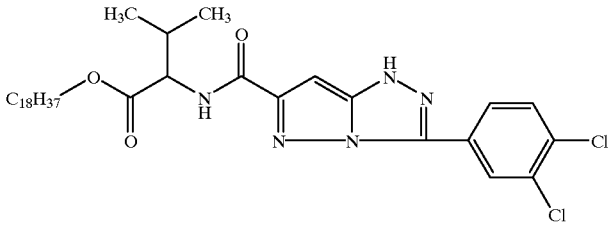
(3)
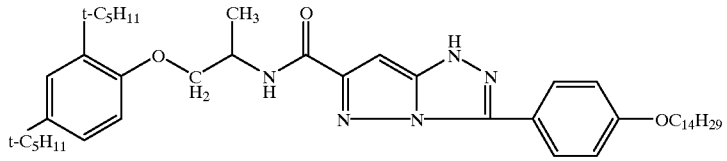
(4)
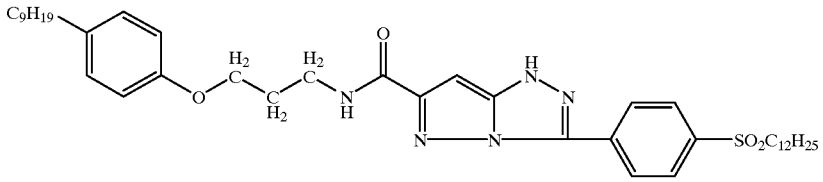
(5)
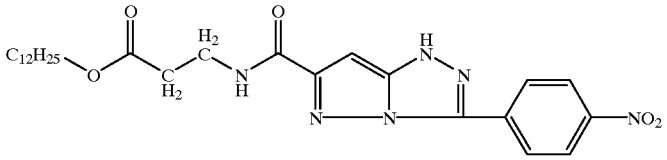
(6)
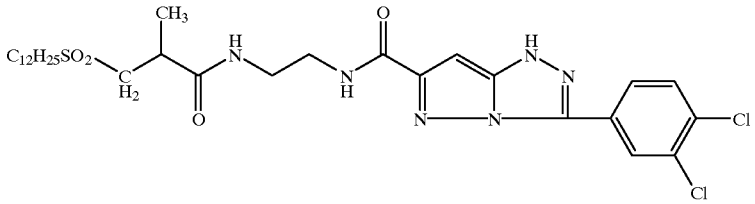

-continued
(7)
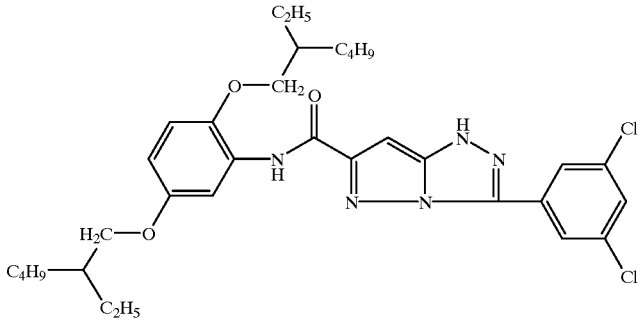
(8)
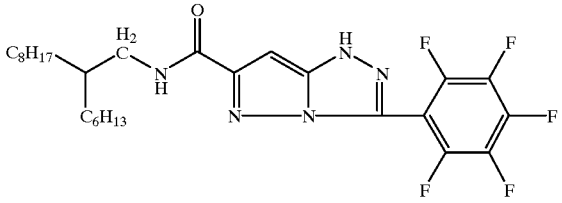
(9)
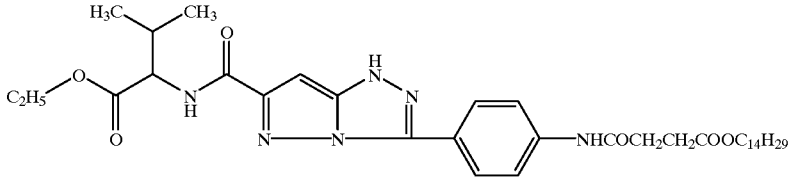
(10)
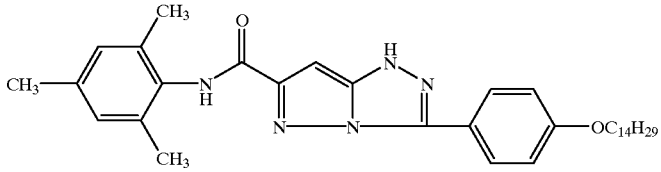
(11)
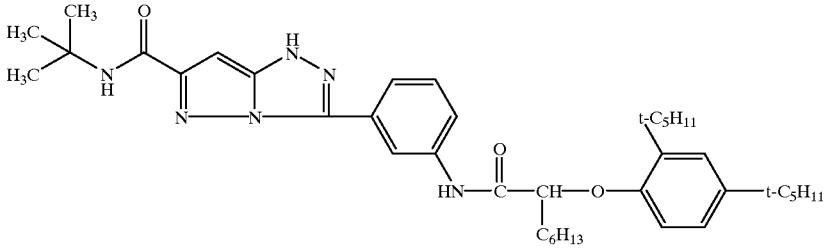

-continued
(12)
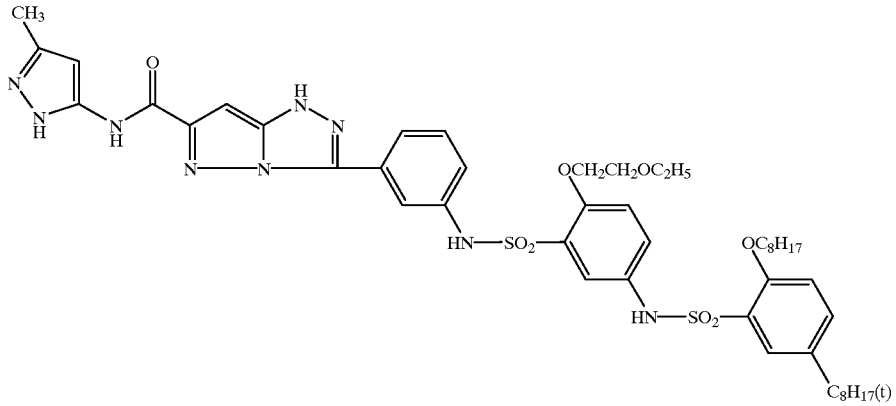
(13)
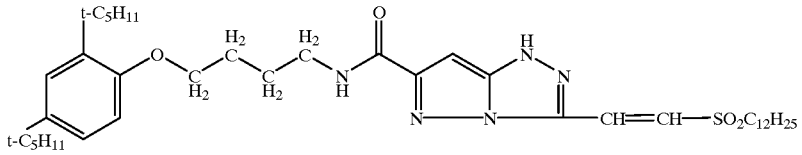
(14)
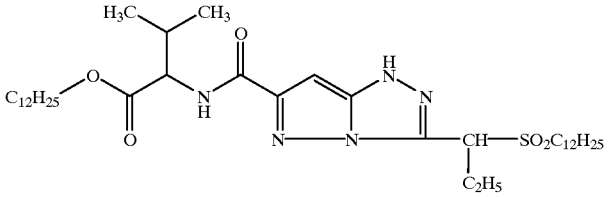
(15)
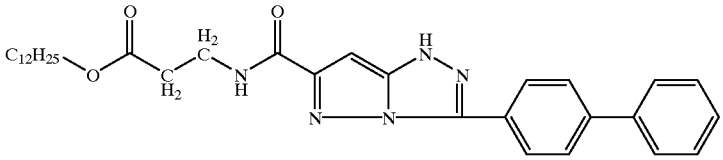
(16)
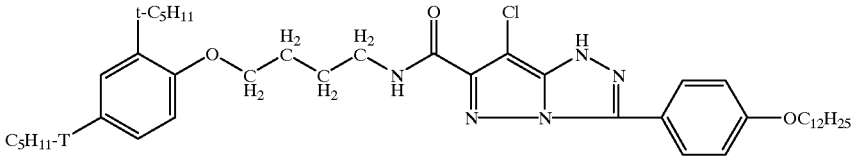
(17)
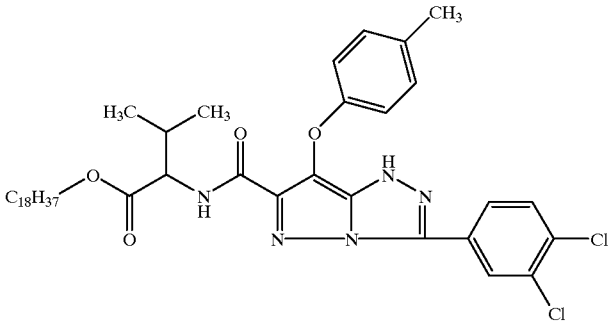

-continued
(18)
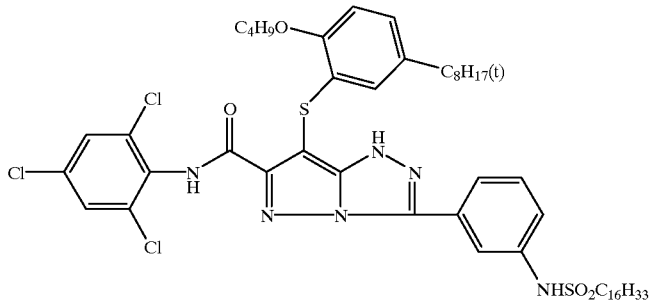
(19)
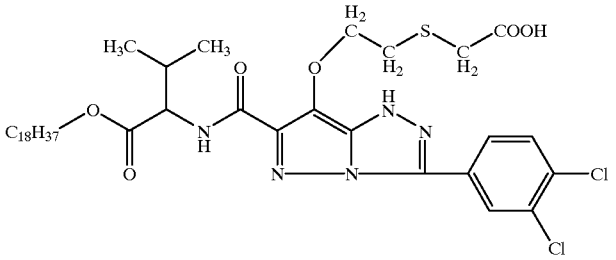
(20)
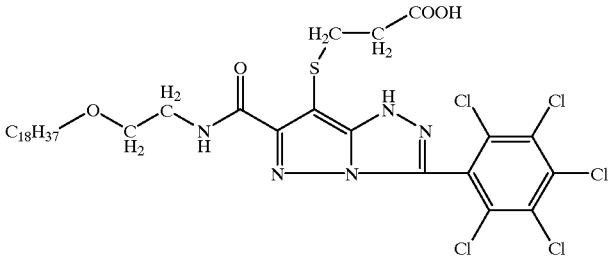
(21)
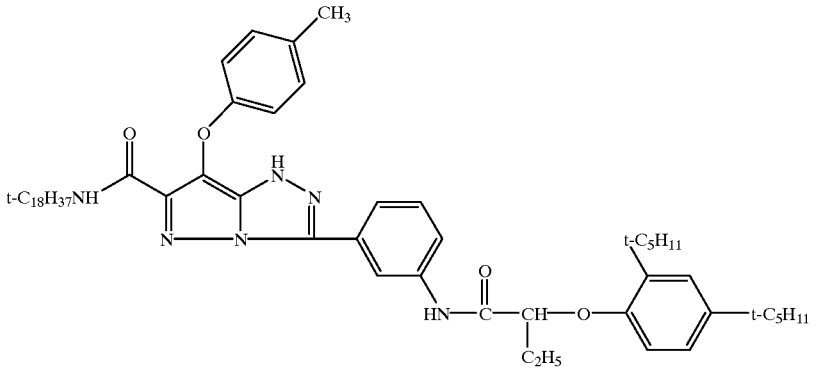
(22)
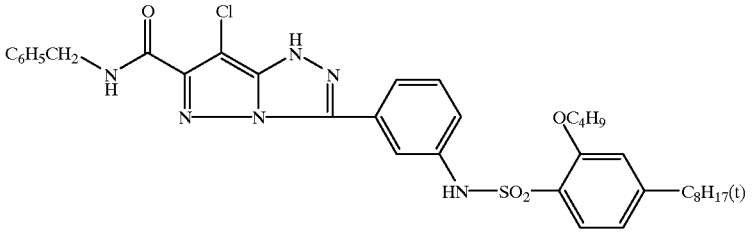

-continued
(23)
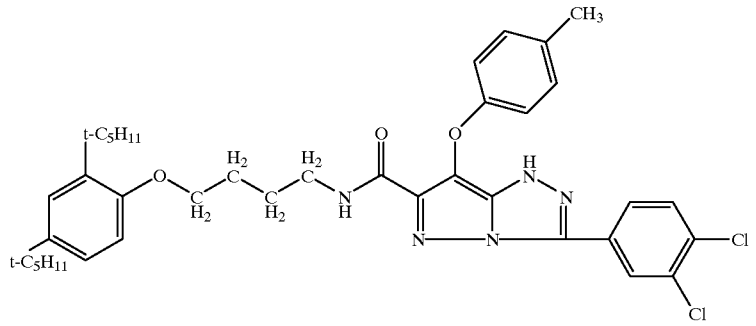
(24)
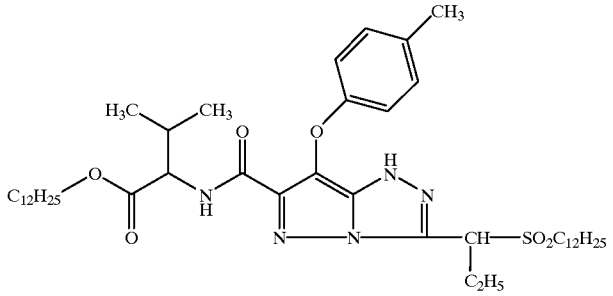
(25)
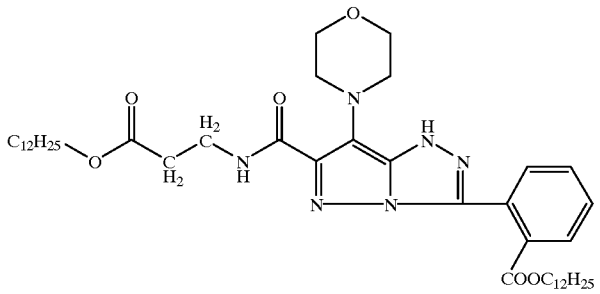
(26)
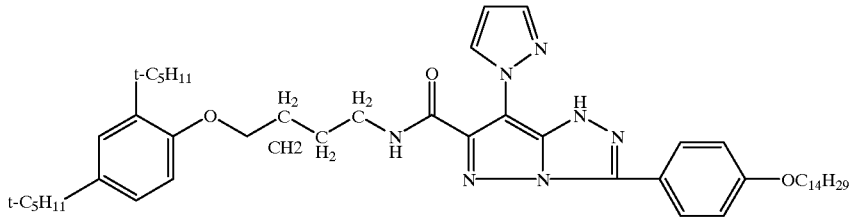
(27)
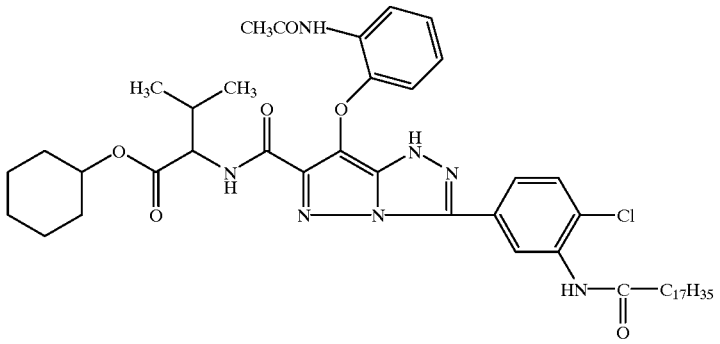

-continued (28)

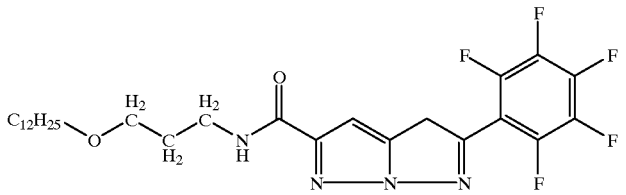

(29)

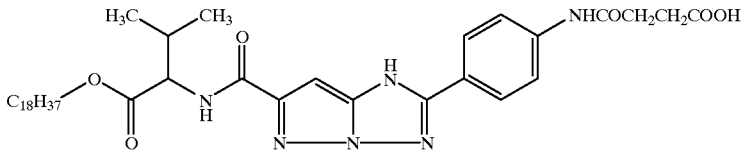

(30)

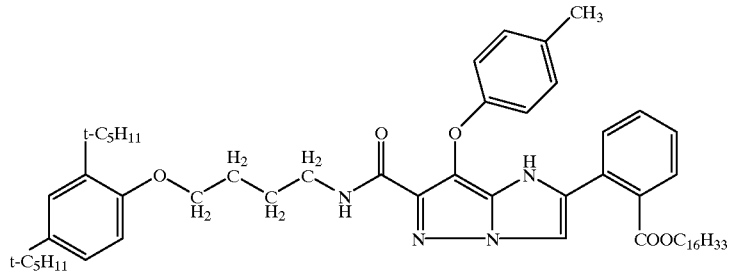

The cyan couplers represented by formulas (1) and (2) are readily synthesized according to a known methods. As an example synthesis of the cyan coupler (2) is illustrated.

(I) Synthesis of Exemplified Compound A-4

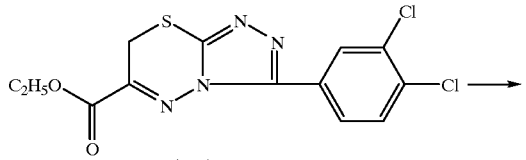

(A-1)

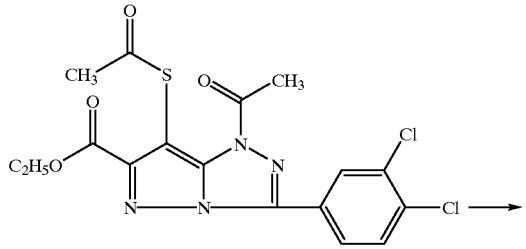

(A-2)

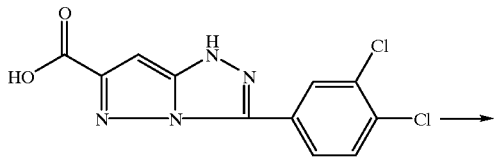

(A-3)

-continued

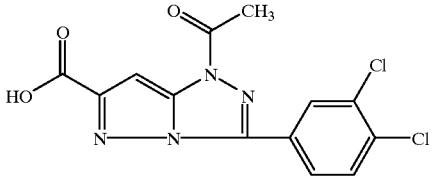

(A-4)

1-1. Synthesis of A-2

Compound (A-1) in an amount of 375 g (1 mol) was reacted in 700 ml of acetic acid anhydride with heating and refluxing for two hours. After the reaction solvent was removed under reduced pressure to obtain the Compound (A-2). The resulted Compound (A-2) was used as the raw material in the next step without refining.

1-2. Synthesis of A-3

To the resulted A-2, 2 liters of acetic acid and 2 liters of hydrobromic acid were added and then 82.0 g (1 mol) of phosphorous acid and 3.32 g (2 mols) of potassium iodide were added and they were reacted in the nitrogen gas at 95 to 100° C. for 4 hours.

After completing the reaction, the resulting crystals by cooling were filtrated and were then washed, so that 291 g of (A-3) were obtained. The yield was 98%. Purity was 99%. They were detected by high speed liquid chromatography.

1-3. Synthesis of Compound A-4

The Compound A-3 of 1750 g (5.90 mol) was reacted in 14 l of acetonitril and 480 ml of pyrimidine for 4 hours while heating and refluxing. After completing the reaction, the resutant was cooled to the room temperature then it was added slowly into a mixture of 516 ml of 35% hydrochloric acid and 12 l of water. The deposited crystals were filtrated. The crystals were washed with 3 l of water two times and 4 l of acetonitril once, then were dried to obtain 1975 g of A-4. The yield was 99%.

(ii) Synthesis of Exemplified Compound A-5

Synthesizing scheme

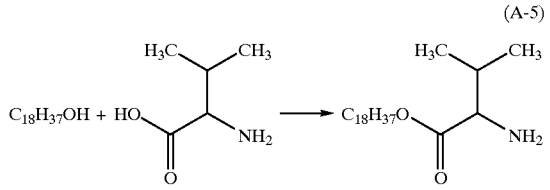

2-1. Synthesis of Compound A-5

Stearyl alcohol of 1,620 g (6 mols), DL-valine of 703 g (6 mols) and p-toluensulfonic acid monohydrate of 1,370 g (7.2 mols) were reacted in 10 l of toluen with heating and refluxing removing produced water by the reaction for 8 hours.

After the reaction the deposited crystals which were p-toluene sulfonic salt of Compound A-5, were filtrated. The crystals were dispersed in 10 l of toluene, were washed 5 1 of 5% aqueous solution of sodium hydrocarbonate three times. Then organic phase was separated solvent was removed by distillation under reduced pressure to obtain 1,885 g of the Compound A-5, the yield was 85%.

(iii) Synthesis of Exemplified Cyan Coupler (2)

Scheme

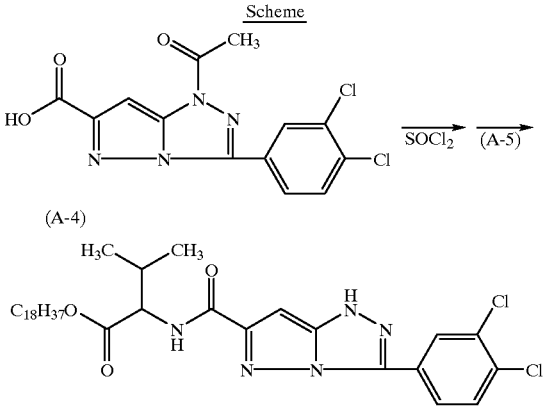

3-1. Synthesis of Exemplified Cyan Coupler (2)

Compound A-4 of 1,700 g (5.01 mols) and 10 g of N,N-dimethylformamido were added to 17 l of toluene, 1,790 g (15.0 mols) of thionyl chloride was added, and they were reacted for 5.5 hours at about 70° C. After the reaction, solvent was removed by distillation under reduced pressure. To the residue 6 l of toluen was added and then it was removed by distillation under reduced pressure.

The resulted residue was dispersed in 17 l of ethylacetate, and 1,852 g (5.01 mols) of Compound A-5, which was dissolved in 3.2 l of ethylacetate, was dripped in the dispersion while stirring at room temperature. To the mixture, 3 l of water containing 319 g (3.01 mols) sodium carbonate was dripped. After the addition they were reacted for two hours at room temperature. After that 1,310 ml of 29% aqueous ammonium was dripped, then they were reacted for 1 hour at room temperature.

After completing the reaction, the reactant was neutralized with dilute hydrochloric acid, and organic phase was separated by standing at 40° C. The separated organic phase was washed with 4 l of 2% hydrochloric acid aqueous solution once and 4.5 l of water 5 times. Solvent was removed by distillation under reduced pressure.

Thereafter, 9.7 l of ethanol was added to the resulting residue, and they were heated to dissolve the residue, and 65 g of active charcoal was added, then filtrated at about 60° C. The resulted liquid was cooled by standing with stirring to crystallize, the deposited crystals were filtrated. The resulted crystals were washed with 5 l of ethanol, and were dried to obtain 2919 g of the end compound the Cyan Coupler 2. (The yield was 90%)

The structure of the Cyan Coupler 2 was confirmed in $^1$H-NMR, IR and MASS spectrography.

The other cyan couplers can be synthesized in the similar way.

Cyan Coupler represented by formula C-I is described.

In the Formula C-I, $R_A$ is an alkyl group having 2 to 6 carbon atoms. The alkyl group may be straight or branched, and may have a substituent.

In the Formula C-I $R_B$ represents a ballast group. The ballast group is an organic group having volume, configuration and function that the ballast group gives the coupler so that the coupler does not transfer to the other layers from applied layer. A preferable example of the ballast group is represented by formula C-II.

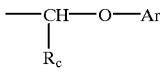

In the Formula C-II $R_c$ is an alkyl group having 1 to 12 carbon atoms. Ar is an aryl group such as a phenyl group, which may have a substituent. The substituent includes, for example, straight or branched alkyl group, an aryl group, a halogen atom, a cyano group, an alkoxycarbonyl group, an acylamino group, a sulfonyl amino group and so on. The preferable example is an alkyl group.

In the Formula C-II Z is a hydrogen atom or an atom or a radical which is capable of being released upon reaction with an oxidation product of a color developing agent. Examples of Z are those represented by $X_1$ in the Formula (1).

In the Formula C-I, $R_A$ is preferably an ethyl group, and Z is preferably a chlorine atom.

Cyan coupler represented by the formula C-I is illustrated.
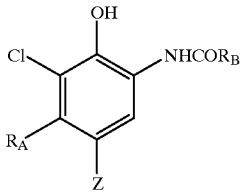
| | $R_A$ | Z | $R_B$ |
|---|---|---|---|
| C-1 | $—C_2H_5$ | —Cl | 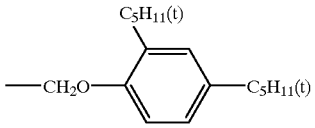 |
| C-2 | $—C_2H_5$ | —Cl | 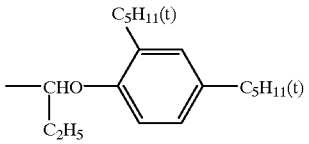 |
| C-3 | $—C_2H_5$ | 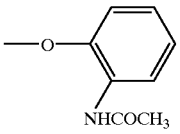 | 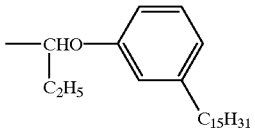 |
| C-4 | $—C_3H_7(i)$ | —Cl | 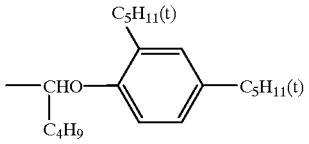 |
| C-5 | $—C_2H_5$ | —F | 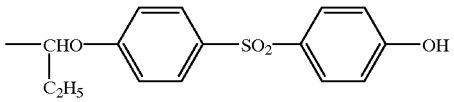 |
| C-6 | $—C_2H_5$ | —Cl | 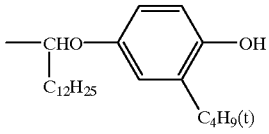 |
| C-7 | $—C_2H_5$ | —Cl | 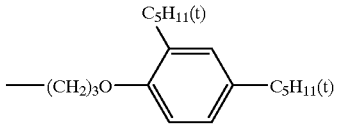 |
| C-8 | $—C_2H_5$ | —Cl | 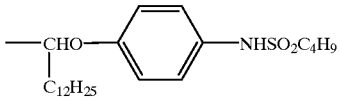 |

-continued
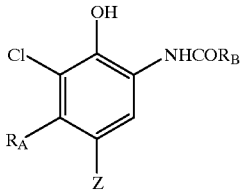
| | $R_A$ | Z | $R_B$ |
|---|---|---|---|
| C-9 | $—C_2H_5$ | 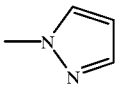 | 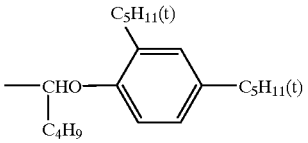 |
| C-10 | $—C_2H_5$ | —Cl | $—C_{15}H_{31}$ |
| C-11 | $—C_2H_5$ | $—OCH_2CH_2SCH_2COOH$ | 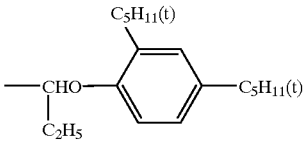 |
| C-12 | $—C_4H_9(t)$ | —Cl | 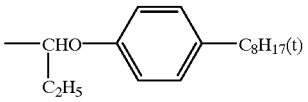 |
| C-13 | $—C_2H_5$ | —Cl | 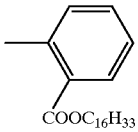 |
| C-14 | $—C_2H_5$ | —Cl | 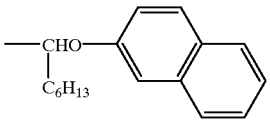 |
| C-15 | $—C_2H_5$ | —Cl | 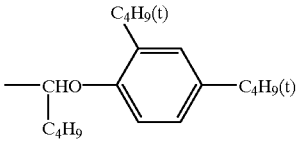 |
| C-16 | $—C_2H_5$ | —Cl | $—CH_2CH_2COOC_{14}H_{29}$ |
| C-17 | $—C_2H_5$ | —Cl | 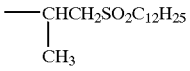 |
| C-18 | $—C_2H_5$ | $—OCH_2COOCH_3$ | $—C_{17}H_{35}$ |

-continued

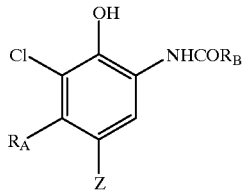

| | $R_A$ | Z | $R_B$ |
|---|---|---|---|
| C-19 | $—C_2H_5$ | —Cl | 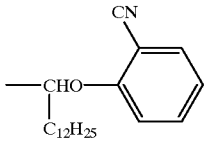 |
| C-20 | $—C_2H_5$ | —Cl | 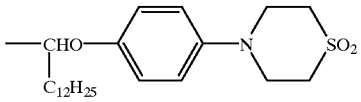 |

In order to add a coupler to a color light-sensitive material, if an oil-in-water drop type emulsifying and dispersion method is used, in a water-insoluble high boiling organic solvent whose boiling point was 150° C. or more, a low boiling and/or water-soluble organic solvent were dissolved in combination. In the oil particles a hydroquinone derivative, UV ray absorber, anti-color fading agent and so on can be contained.

In case that the color photographic material of the invention used as a full color photographic material, a magenta coupler and a yellow coupler are used as well as the cyan coupler.

As a magenta dye forming coupler, a 5-pyrazolone based coupler, a pyrazolone benzimidazole based coupler. a pyrazoloazole based coupler and an open-chained acylacetonitrile based coupler are cited.

As a yellow coupler an open chained ketomethylene coupler can be used. The examples include an acylacetoanilido type coupler is used. Of these, a benzoyl acetoanilido based and a pivaloyl acetoanilido based compounds are useful.

With regard to the form of the silver halide grains used in the silver halide emulsion layer, arbitrary ones may be used. Examples include silver chloride, silver bromide, silver iodide, silver chlorobromide, silver iodoromide, silver iodobromide and so on.

With regard to the silver halide grain, grains composed of a single form may be used. In addition, grains in which various forms are mixed may be used.

There is no limit to the grain size of the silver halide grain. Considering other photographic performances such as rapid processing property and sensitivity, the range of 0.2–1.6 $\mu$m is preferable and 0.25–1.2 $\mu$m is more preferable. The above-mentioned grain size can be measured by means of each method commonly employed in the relevant technical field. Typically, methods described in "Grain Size Analysis Method" by Loveland (A.S.T.M. Symposium on Light Microscopy, pp. 94–122 (1955) or "Theory of Photographic Process Third Edition" (written by Meeth and James, 2nd chapter, published by MacMillan Inc., 1966).

Aforesaid grain size can be measured by the use of a projected area of the grain or a diameter approximate value. If the grain is substantially uniform, the grain size distribution can considerably be represented in terms of a diameter or a projected area.

The distribution of the grain size of the silver halide grain used for the present invention may be polydispersed. However, preferably a mono-disperse silver halide grain whose variation coefficient was preferably 0.22 or less and more preferably a mono-dispersed silver halide grains whose variation coefficient was 0.15 or less. It is specifically preferable to add two or more kinds of mono-dispersed emulsions whose variation coefficient is respectively 0.15 or less. Here, the variation coefficient is a coefficient representing the width of grain size distribution, and is defined by the following equation:

"Variation coefficient"=S/R (S: the standard variation of the grain size distribution, R: average grain size)

wherein, the grain size is defined to be a diameter in the case of a spherical silver halide grains. In addition, the form of the grain is other than cubic or spherical, it is defined to represent a diameter when its projected image is converted to a circle image having the same area.

The silver halide emulsion may be produced by means of any of an acidity method, a neutral method and an ammonia method. Aforesaid grain may be grown linearly. In addition, aforesaid grain may be grown after seed grains were prepared. A method to prepare a seed grain and a method to grow may be the same or different.

In addition, with regard to a style to react a soluble silver salt and a soluble halide product, any methods including an ordinary mixing method, a reverse mixing method and their mixture may be adopted. Among these, a double jet method is preferable. As one style of the double jet method, a pAg controlled double jet method described in Japanese Patent O.P.I. Publication No. 54-48521 can be used.

Further, if necessary, silver halide solvent such as thioether may be used. In addition, compounds having a mercapto group, a nitrogen-containing heterocyclic compound or a sensitizing dye may be added during forming the silver halide grains or after the finish of the formation of the grains.

With regard to the form of the silver halide grains, arbitrary ones may be used. One of preferable examples is cubic having (100) plane as a crystal surface.

Also silver halide grains having octagonal, tetradecahedral and dodecahedral crystal are formed to be used. Silver halide grains having twin surface may be used.

With regard to the silver halide grain, grains composed of a single form may he used. In addition, grains in which various forms are mixed may be used.

The silver halide grains may contain metal ion inside the grain and/or at the surface of grain by adding metal ion using cadmium salt, zinc salt, talium salt, iridium salt or complex, rhodium salt or complex, or iron salt or complex during the grain precipitation process or grain growing process. Or the grain may be given a reduction sensitizing nucleus inside or surface of the grain by making them keep in adequate reduction circumstances.

The photographic emulsion containing the silver halide grains may or may not be subjected to removing undesired soluble salts after growing of the grains. When the salts are removed, a method disclosed in Research Disclosure (RD) 17643 can be applied.

The silver halide grains are preferably those the latent image is formed on the surface of the grains. The grains which forms the latent image internal may be used.

The silver halide grains may be sensitized with carcogen sensitizer. The carcogen sensitizer is a generic name of sulfur sensitizer, selenium sensitizer and tellurium sensitizer. Among these sulfur sensitizer and selenium sensitizer are preferably used. The sulfur sensitizer includes, for example, thiosufuric acid, arylthiocarbazid, thiourea, arylisothiocyanate, cystyne, p-toluenethiosulfonate, and rhodanine. In addition thereto, the sulfur sensitizer disclosed in U.S. Pat. Nos. 1,574,944, 2,410,698, 2,278,947, 2,728,668, 3,501,313, 3,656,955, German Patent OLS No. 1,422,869, JP OPI Publication Nos. 56-24937 and 55-45046. Amount of the sulfur sensitizer to be added is changed widely in accordance with the conditions such as pH, temperature and grain size. Roughly $10^{-7}$ to $10^{-1}$ mol per 1 mol of silver halide is preferable.

To the silver halide emulsion the sensitization such as reduction sensitization using reducing material and noble metal sensitization using noble metal may be applied in addition to the carcogenide sensitization.

The silver halide color photographic material may contain a water soluble dyes such as filter dye or anti-irradiation dye in hydrophilic colloidal layer or other dye for the various purposes.

To the light-sensitive material, other than the above-mentioned compounds, various photographic additive may be added. For example, anti-fogging agents, development accelerators, development retarders, bleaching accelerators, stabilizers, UV absorbing agents, anti-color stain agent, fluorescent brightening agents, anti-dye image fading agents, anti-static agents, hardening agents, surface active agents, plasticizing agent, moisture controlling agents and so on. As for these additives reference is made to RD 17643.

In addition, a compound that releases such a photographically useful fragment on coupling with an oxidation product of color developing agent as a development accelerator, a bleaching accelerator, a silver halide solvent, a hardening agent, a fogging agent, an anti-fogging agent, a chemicals sensitizer, an optical sensitizer and sensitivity reducing agent may be used.

As a support used for the color light-sensitive material, any materials can be used. For example, baryta paper, polyethylene-laminated paper, glass, cellurose acetate, cellulose nitrate, polyester film such as polyethyleneterephthalate, polyamide film, polycarbonate film, polystylene film can be used. In case the support is opaque, it may contain a reflective layer may be used. The support is selected for the use purpose of the photographic materials.

Various coating methods can be used for coating the emulsion layer or other layers of the photographic materials. Examples include dipping coating, air doctor coating, curtain coating, hopper coating. Other examples coating two or more layers simultaneously are described in U.S. Pat. Nos. 2,781,791, 2,9441,898.

Each emulsion layer is arranged optionally. An arrangement which blue sensitive layer, a green sensitive layer and a red sensitive layer are provided in this order on the support is preferably.

In the photographic light sensitive material an inter layer having suitable thickness can be provided optionally, and various layer such as a filter layer, an anti-curing layer, a protective layer, an anti-halation layer and so on. These layers may be applied in combination.

A hydrophilic colloid can be used as the binder of the layers, whose preferable example is a gelatin. In each layer various photographic additives recited for the silver halide emulsion layer may be added.

The color light-sensitive material may form an image by applying a color developing processing. Typical examples include a method comprising color development, bleach-fixing and if necessary rinsing and/or stabilizing, a method comprising a color development, after that bleaching and fixing separately, and if necessary rinsing and/or stabilizing. The photographic material according to the present invention is suitable for a rapid processing comprising steps of color development, bleach-fixing, and rinsing or stabilizing.

EXAMPLE

Hereinafter, the present invention will be explained referring to Examples.

Example 1

On one of the surface of paper a high density polyethylene was laminated for forming a paper support. On a side on which polyethylene containing titanium oxide was laminated emulsion layers were coated to prepare a multi-layered silver halide color light sensitive photographic material Sample 1. The coating composition was prepared as followed.

Coating Composition for the First Layer

To 30.1 g of yellow coupler (Y-1), 4.68 g of dye image stabilizer (ST-1), 6.03 g of ST-2, 0.67 g of anti-stain agent (HQ-1), 0.34 g of anti-irradiation dye (AI-3) and 9.0 ml of high boiling organic solvent (DBP), 60 cc of ethyl acetic acid was added for solving. To the solution 220 ml of an aqueous 10% gelatin solution containing 7 ml of 20% surfactant (SU-1) were added and then emulsified and dispersed in using a supersonic homogenizer for preparing a yellow coupler dispersing composition. This dispersing composition was mixed with a blue sensitive silver halide emulsion prepared under the following conditions containing 8.68 g of silver for preparing a coating composition for the first layer.

Coating compositions for the second layer through the seventh layer were prepared as shown in Tables 1 and 2.

As hardeners, H-1 was added in the 2nd and 4th layer, and H-2 was added in the 7th layer. As a coating aid, surfactants SU-2 and SU-3 were added to regulate surface tension. The amount is shown in terms of $g/m^2$ as far as otherwise specified.

TABLE I

| Layer | Constitution | Amount ($g/m^2$) |
|---|---|---|
| 7th layer (Protective layer) | Gelatin | 1.00 |
| | HQ-2 | 0.002 |
| | HQ-3 | 0.002 |
| | HQ-4 | 0.004 |
| | HQ-5 | 0.02 |
| | DIDP | 0.005 |
| | F-1e | 0.002 |
| 6th layer (UV absorber) | Gelatin | 0.40 |
| | UV absorber (UV-1) | 0.10 |
| | UV absorber (UV-2) | 0.04 |
| | UV absorber (UV-3) | 0.16 |
| | HQ-5 | 0.04 |
| | AI-2 | 0.03 |
| | PVP | 0.03 |
| | DNP | 0.20 |
| 5th layer Red sensitive layer) | Gelatin | 1.30 |
| | Red sensitive silver bromochloride emulsion (Em-R) | 0.21 |
| | Cyan coupler (C-2) | 0.37 |
| | Anti-stain agent (HQ-1) | 0.01 |
| | HBS-1 | 0.20 |
| | DOP | 0.20 |
| 4th layer (UV absorber) | Gelatin | 0.94 |
| | UV absorber (UV-1) | 0.28 |
| | UV absorber (UV-2) | 0.09 |
| | UV absorber (UV-3) | 0.38 |
| | Anti-stain agent (HQ-5) | 0.10 |
| | DNP | 0.40 |

TABLE 2

| Layer | Composition | Amount ($g/m^2$) |
|---|---|---|
| 3rd layer (Green sensitive layer) | Gelatin | 1.40 |
| | AI-1 | 0.01 |
| | Green sensitive silver bromochloride emulsion (Em-G) | 0.17 |
| | Magenta coupler (M-1) | 0.23 |
| | Dye image stabilizer (ST-3) | 0.20 |
| | Dye image stabilizer (ST-4) | 0.17 |
| | DIDP | 0.13 |
| | DBP | 0.13 |
| 2nd layer (Intermediate layer) | Gelatin | 1.20 |
| | Anti-stain agent (HQ-2) | 0.03 |
| | Anti-stain agent (HQ-3) | 0.03 |
| | Anti-stain agent (HQ-4) | 0.05 |
| | Anti-stain agent (HQ-5) | 0.23 |
| | DIDP | 0.06 |
| | Compound (F-1) | 0.002 |
| 1st layer (Blue sensitive layer) | Gelatin | 1.20 |
| | Blue sensitive silver bromochloride emulsion (Em-B) | 0.26 |
| | Yellow coupler (Y-1) | 0.90 |
| | Dye stabilizer (ST-1) | 0.14 |
| | Dye stabilizer (ST-2) | 0.18 |
| | Anti-stain agent (HQ-1) | 0.02 |
| | AI-3 | 0.01 |
| | DBP | 0.28 |
| Support | Polyethylene-laminated paper (Fine amount of colorant is contained) | |

Added amount of silver halide emulsion was denoted in terms of silver.

SU-1: Sodium tri-i-propylnaphthalene sulfonic acid
SU-2: Sodium salt of sulfosuccinic acid di(2-ethylhexyl)
SU-3: Sodium salt of sulfosuccinic acid di (2,2,3,3,4,4,5,5-octafluoropentyl
DBP: Dibutylphthalate
DNP: Dinonylphthalate
DOP: Dioctylphthalate
DIDP: Di-i-decylphthalate
PVP: Polyvinyl pyrrolidone
HQ-1: 2,5-di-t-octyl hydroquinone
HQ-2: 2,5-di-sec-dodecyl hydroquinone
HQ-3: 2,5-di-sec-tetradecyl hydroquinone
HQ-4: 2-sec-dodecyl-5-sec-tetradecyl hydroquinone
HQ-5: 2,5-di(1,1-dimethyl-4-hexyloxycarbonyl)butyl hydroquinone
H-1: Tetrakis(vinylsulfonylmethyl)methane
H-2: Sodium 2,4-dichloro-6-hydroxy-s-triazine

Y-1

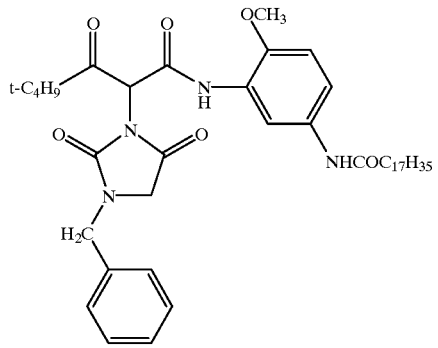

M-1

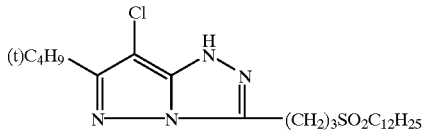

(Preparation of Blue Sensitive Silver Halide Emulsion)

To 1 liter of an aqueous 2% gelatin solution kept at 40° C., the following solutions A and B were simultaneously added in 30 minutes while controlling pAg at 6.5 and pH at 3.0. In addition, the following solutions C and D were added thereto in 180 minutes while controlling pAg at 7.3 and pH at 5.5. In this occasion, pH was controlled by the use of sulfuric acid or an aqueous sodium hydroxide and pAg was regulated by using the regulating solution. The regulating solution is composed of aqueous solutions of sodium chloride and potassium bromide, ratio of chloride ion to bromide ion is 99.8:0.2, and the concentration is 0.1 mol/l when used to mix solution A and solution B, 1 mol/l when used to mix solution C and solution D.

| | |
|---|---|
| (Solution A) | |
| Sodium chloride | 3.42 g |
| Potassium bromide | 0.03 g |
| Water was added to make up 200 ml. | |
| (Solution B) | |
| Silver nitrate | 10 g |
| Water was added to make 200 ml. | |
| (Solution C) | |
| Sodium chloride | 102.7 g |
| Potassium bromide | 1.0 g |
| Water was added to make 600 cc. | |
| (Solution D) | |
| Silver nitrate | 300 g |
| Water was added to make 600 ml. | |

After adding the above-mentioned solutions, the resulting mixture was subjected to desalting employing a 5% aqueous Demol solution (produced by Kao Atlas) and a 2.0% aqueous solution of magnesium sulfate. Following this, it was mixed with an aqueous gelatin solution for obtaining a mono dispersed cubic emulsion EMP-1 wherein the average grain size was 0.85 μm, variation coefficient of grain size distribution was 0.07 and the silver chloride.

The above-mentioned EMP-1 was subjected to the most suitable chemical sensitization at 60° C. using the following compounds so that a blue-sensitive silver halide emulsion (Em-B) was obtained.

| | |
|---|---|
| Sodium thiosulfate | 0.8 mg/mol AgX |
| Chloro auric acid | 0.5 mg/mol AgX |
| Stabilizer STAB-1 | $6 \times 10^{-4}$ mol/mol AgX |
| Sensitizing dye BS-1 | $4 \times 10^{-4}$ mol/mol AgX |
| Sensitizing dye BS-2 | $1 \times 10^{-4}$ mol/mol AgX |

Preparation of Green Sensitive Silver Halide Emulsion)

In the same manner as in EMP-1 except that the addition times of Solutions A and B and Solutions C and D, monodispersed cubic emulsion EMP-2 having an average grain size of 0.43 μm, variation coefficient of 0.08 and silver chloride content of 99.5% was obtained.

The above-mentioned EMP-2 was subjected to the most suitable chemical sensitization at 55° C. using the following compounds so that a blue-sensitive silver halide emulsion (Em-G) was obtained.

| | |
|---|---|
| Sodium thiosulfate | 1.5 mg/mol AgX |
| Chloro auric acid | 1.0 mg/mol AgX |
| Stabilizer STAB-1 | $6 \times 10^{-4}$ mol/mol AgX |
| Sensitizing dye GS-1 | $4 \times 10^{-4}$ mol/mol AgX |

Preparation of Red Sensitive Silver Halide Emulsion)

In the same manner as in EMP-1 except that the addition times of Solutions A and B and Solutions C and D, monodispersed cubic emulsion EMP-3 having an average grain size of 0.50 μm, variation coefficient of 0.08 and silver chloride content of 99.5% was obtained.

The above-mentioned EMP-3 was subjected to the most suitable chemical sensitization for 90 minutes at 60° C. using the following compounds so that a blue-sensitive silver halide emulsion (Em-R) was obtained.

| | |
|---|---|
| Sodium thiosulfate | 1.8 mg/mol AgX |
| Chloro auric acid | 2.0 mg/mol Agx |
| Stabilizer STAB-1 | $6 \times 10^{-4}$ mol/mol AgX |
| Sensitizing dye RS-1 | $1 \times 10^{-4}$ mol/mol AgX |

STAB-1 is 1-(3-acetoamidephenyl)-5-mercaptotetrazole.

BS-1

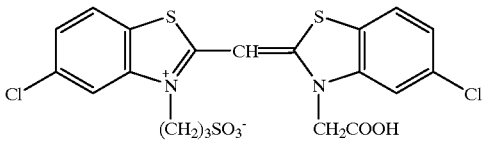

BS-2

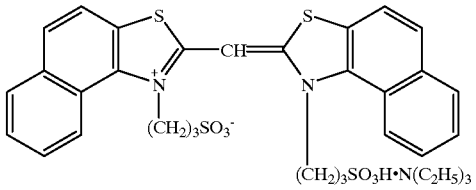

GS-1

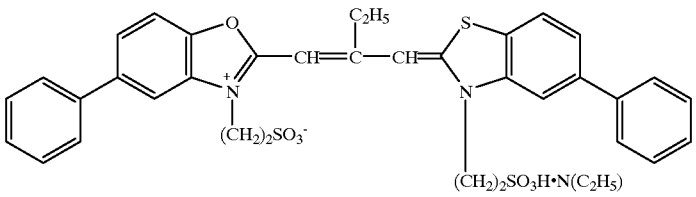

RS-1

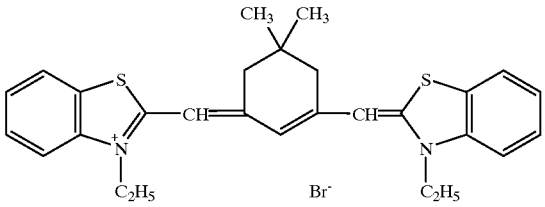

-continued
ST-1
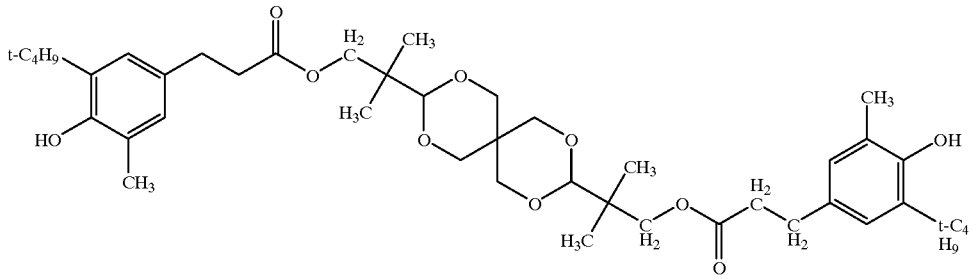
ST-2
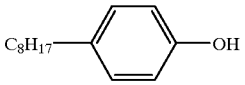
ST-3
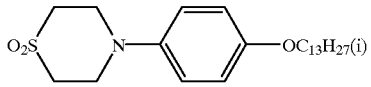
ST-4
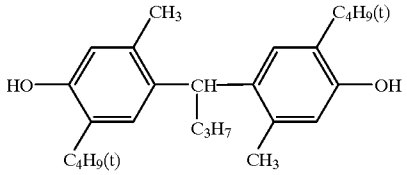
HBS-1
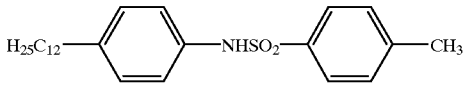
UV-1
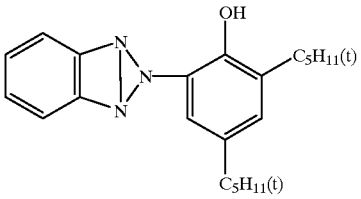
UV-2
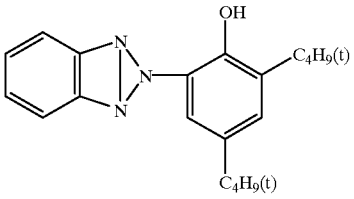
UV-3
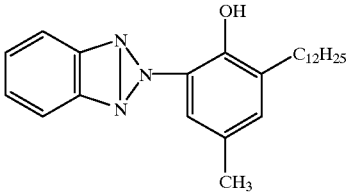

-continued

AI-1

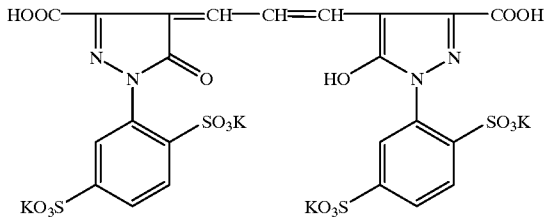

AI-2

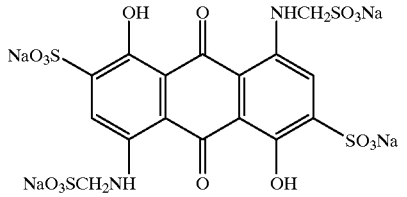

AI-3

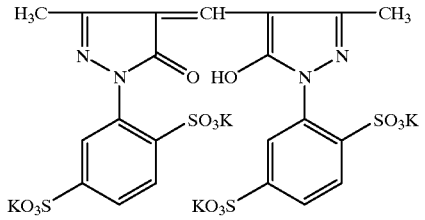

F-1

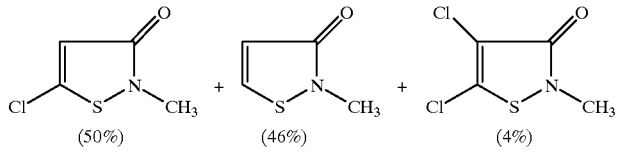

(50%) (46%) (4%)

(MOLAR RATIO)

Samples 2 to 24 were prepared in the same manner as in Sample 1 except that the cyan coupler (C-1) and its amount was replace as shown in Table 3.

Samples thus prepared was subjected to wedge exposure to light by means a convertional method. Exposed samples were processed by the following condition.

| Processing step | Processing Temperature | Time |
|---|---|---|
| Color developing | 38.0 ± 0.3° C. | 27 sec. |
| Bleach fixing | 38.0 ± 0.5° C. | 27 sec. |
| Stabilizing | 30–34° C. | 60 sec. |
| Drying | 60–80° C. | 30 sec. |

The composition of photographic processing solution is shown as below:

| Color developer | |
|---|---|
| Deionized water | 800 ml |
| Triethylenediamine | 10 g |
| N,N-diethylhydroxylamine | 5 g |
| Potassium bromide | 0.02 g |
| Potassium chloride | 2 g |
| Potassium sulfite | 0.3 g |
| 1-hydroxyetylidene-1,1-diphosphonic acid | 1.0 g |
| Ethylenediamine tetraacetic acid | 1.0 g |
| Dietyleneglycol | 10 g |

-continued

| Color developer | |
|---|---|
| N-ethyl-N-(β-methanesulfonamideethyl)3-methyl-4-aminoaniline sulfate | 6.0 g |
| Fluorescent brightening agent (4,4'-diaminostylbene disulfonic acid derivative) | 2.0 g |
| Potassium carbonate | 27 g |

Water was added to make 1 liter in total. pH of the tank solution was adjusted to 10.10.

| Bleach-fixing | |
|---|---|
| Dihydrate ammonium ferric diethylenetriamine pentaacetic acid | 60 g |
| Diethylenetriamine pentaacetic acid | 3 g |
| Ammonium thiosulfate (70% aqueous solution) | 100 ml |
| Ammonium sulfite (40% aqueous solution) | 27.5 ml |

Water was added to make 1 liter in total. pH was adjusted to 5.7 with potassium carbonate or glacial acetic acid.

| Stabilizer | |
|---|---|
| 5-chloro-2-methyl-4-isothiazoline-3-on | 0.2 g |
| 1.2-benzisothiazoline-3-on | 0.3 g |

-continued

| Stabilizer | |
|---|---|
| Ethylene glycol | 1.0 g |
| 1-hydroxyethylidene-1,1-diphosphonic acid | 2.0 g |
| o-phenylphenol sodium | 1.0 g |
| Ethylenediamine tetraacetic acid | 1.0 g |
| Hydroxyammonium (20% aqueous solution) | 3.0 g |
| Fluorescent brightening agent (4,4'-diaminostylbene sulfonic acid derivative) | 2.0 g |

Water was added to make 1 liter in total. pH was adjusted to 7.5 with sulfuric acid and aqueous potassium hydroxide.

The maximum density and color reproduction of each samples were measured in the following way:

Maximum Density

The maximum density ($D_{max}^{R}$) of each sample subjected to processing of the red sensitive emulsion layer was measured by means of a PDA-65 densitometer (produced by Konica).

Color Reproduction

A Machbeth color checker was taken with a camera (Konica FT-1 MOTOR, product of Konica Corporation) on a color film (Konica Color LV\400, product of Konica Corporation). The film was processed with color negative processing (CNK-4, Konica Corporation), and the resulted negative image was printed by Konica Color Printer CL-P2000 (product of Konica Corporation)in a size of 82 mm by 117 mm. The printing condition was set up so that the gray on the color checker was made gray for each sample.

The color reproduction of the resulted samples were measured by eye-viewing of 20 test persons to give five grades.

Grade 5: 18 to 20 persons of 20 tester felt good color reproduction

Grade 4: 14 to 18 persons of 20 tester felt good color reproduction

Grade 3: 10 to 13 persons of 20 tester felt good color reproduction

Grade 2: 6 to 9 persons of 20 tester felt good color reproduction

Grade 1: 0 to 5 persons of 20 tester felt good color reproduction

The result is summarized in Table 3.

TABLE 3

| No. | Cyan Coupler | Amount of Cyan Coupler ($10^{-4}$ mol/m$^2$) | Maximum Density | Color Reproduction |
|---|---|---|---|---|
| 1 | C-2 | 3.7 | 2.20 | 3 |
| 2 | (2) | 3.7 | 2.40 | 2 |
| 3 | (2) | 3.7 | 2.12 | 3 |
| 4 | (a) | 3.7 | 2.12 | 1 |
| 5 | (a)/C-2 | 2.0/3.7 | 2.26 | 3 |
| 6 | (2)/(b) | 2.0/3.7 | 2.24 | 3 |
| 7 | (2)/C-2 | 2.0/3.7 | 2.52 | 5 |
| 8 | (1)/C-2 | 2.0/3.7 | 2.50 | 5 |
| 9 | (7)/C-2 | 2.0/3.7 | 2.47 | 5 |
| 10 | (9)/C-2 | 2.0/3.7 | 2.42 | 4 |
| 11 | (10)/C-2 | 2.0/3.7 | 2.45 | 5 |
| 12 | (11)/C-2 | 2.0/3.7 | 2.40 | 5 |
| 13 | (12)/C-2 | 2.0/3.7 | 2.38 | 4 |
| 14 | (17)/C-2 | 2.0/3.7 | 2.48 | 5 |
| 15 | (20)/C-2 | 2.0/3.7 | 2.36 | 4 |
| 16 | (26)/C-2 | 2.0/3.7 | 2.41 | 4 |
| 17 | (29)/C-2 | 2.0/3.7 | 2.38 | 4 |
| 18 | (2)/C-6 | 2.0/3.7 | 2.45 | 5 |
| 19 | (2)/C-8 | 2.0/3.7 | 2.44 | 5 |
| 20 | (2)/C-10 | 2.0/3.7 | 2.51 | 5 |
| 21 | (2)/C-11 | 2.0/3.7 | 2.44 | 4 |
| 22 | (1)/C-19 | 2.0/3.7 | 2.48 | 5 |
| 23 | (2)/C-15 | 2.0/3.7 | 2.47 | 5 |
| 24 | (10)/C-10 | 2.0/3.7 | 2.45 | 5 |

Cyan Coupler(a)

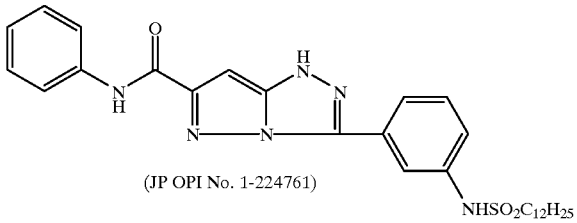

(JP OPI No. 1-224761)

Cyan Coupler(b)

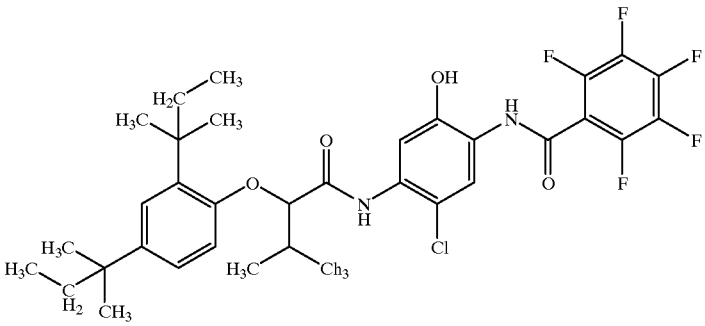

Sample 1 containing cyan coupler C-2 solely does not give sufficient maximum density, and the color reproduction is not satisfactory. Sample 2 containing cyan coupler (2) solely gives allowable maximum density, but the color reproduction is not satisfactory. Samples 3 and 4, whose coupler amount is reduced to half of samples 1 and 2 for the cost saving, give much lower maximum density and inferior color reproduction. Samples 5 and 6, which contains one of a coupler of the invention and one of a coupler fallen outside of the invention, maximum density and color reproduction both are not satisfactory for the practical use. Samples 7 through 24 containing a combination of couplers of the invention show satisfactory maximum density with a small amount of the couplers and good color reproduction.

We claim:

1. A silver halide color photographic light-sensitive material comprising a blue sensitive silver halide emulsion layer, a green sensitive silver halide emulsion layer and a red sensitive silver halide emulsion layer on a support, in which the red sensitive silver halide emulsion layer contains at least one cyan coupler represented by the formula (1) or (2) and at least one cyan coupler represented by formula C-1, Formula (1)

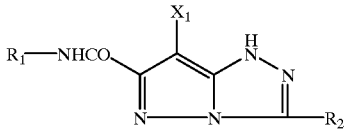

Formula (2)

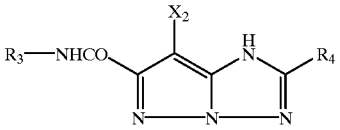

wherein $R_1$ and $R_3$ represent each a branched alkyl group, a substituted alkyl group, a substituted aryl group or a heterocyclic group; $R_2$ and $R_4$ represent each a substituent; and $X_1$ and $X_2$ represent each a hydrogen atom or a coupling-off group, which is capable of being released upon reaction with an oxidation product of a color developing agent, Formula (C-1)

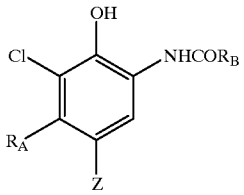

wherein $R_A$ is an alkyl group having carbon number of 2 to 6, $R_B$ is a ballast group, Z is a hydrogen atom or an atom or a radical which is capable of being released upon reaction with an oxidation product of a color developing agent.

2. The silver halide color photographic light-sensitive material of claim 1, wherein the red sensitive silver halide emulsion layer contains at least one cyan coupler represented by the formula (1) and at least one cyan coupler represented by formula C-1.

3. The silver halide color photographic light-sensitive material of claim 2, wherein R1 is a branched alkyl or a substituted alkyl group.

4. The silver halide color photographic light-sensitive material of claim 3, wherein R1 is i-propyl group, t-butyl group, sec-butyl group, i-butyl group, t-octyl group.

5. The silver halide color photographic light-sensitive material of claim 2, wherein $R_2$ is alkyl group, aryl group or heterocyclic group.

6. The silver halide color photographic light-sensitive material of claim 5, wherein $R_2$ is aryl group.

7. The silver halide color photographic light-sensitive material of claim 3, wherein $R_A$ is an ethyl group in the formula (C-1).

8. The silver halide color photographic light-sensitive material of claim 3, wherein Z is a chlorine atom in the formula (C-1).

* * * * *